US007007645B2

(12) United States Patent
Park

(10) Patent No.: US 7,007,645 B2
(45) Date of Patent: Mar. 7, 2006

(54) METHOD AND APPARATUS FOR CONTROLLING CVVT OF AN ENGINE

(75) Inventor: Yong-Jung Park, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/412,704

(22) Filed: Apr. 10, 2003

(65) Prior Publication Data

US 2004/0020452 A1 Feb. 5, 2004

(30) Foreign Application Priority Data

Jul. 31, 2002 (KR) ..... 10-2002-0045247

(51) Int. Cl.
*F01L 1/34* (2006.01)

(52) U.S. Cl. ..... 123/90.15; 123/90.16; 123/90.17

(58) Field of Classification Search ..... 123/90.12, 123/90.15, 90.16, 90.17, 90.18, 90.19
See application file for complete search history.

(56) References Cited

U.S. PATENT DOCUMENTS 5,002,026 A * 3/1991 Ohkumo et al. ..... 123/339.22
5,590,632 A * 1/1997 Kato et al. ..... 123/480
5,924,395 A 7/1999 Moriya et al.
5,967,115 A 10/1999 Konopka et al.
6,098,576 A * 8/2000 Nowak et al. ..... 123/41.33
6,393,357 B1 * 5/2002 Holmes et al. ..... 701/115
6,463,896 B1 * 10/2002 Fujiwara et al. ..... 123/90.11
6,513,469 B1 * 2/2003 Nakamura et al. ..... 123/90.15
6,640,758 B1 * 11/2003 Ashida ..... 123/90.15
6,681,172 B1 * 1/2004 Pfeiffer et al. ..... 701/113
6,751,949 B1 * 6/2004 Tamura et al. ..... 60/284
6,758,187 B1 * 7/2004 Waters ..... 123/198 F

FOREIGN PATENT DOCUMENTS

| | | |
|---|---|---|
| DE | 3621080 | 1/1987 |
| DE | 19731373 | 1/1998 |
| EP | 1-052-378 A2 | 11/2000 |
| JP | 2001-182565 | 6/2001 |

* cited by examiner

*Primary Examiner*—Thomas Denion
*Assistant Examiner*—Zelalem Eshete
(74) *Attorney, Agent, or Firm*—Morgan Lewis & Bockius LLP

(57) ABSTRACT

Controlling of a CVVT can be improved by controlling the CVVT based on an estimated oil temperature, the estimated oil temperature being calculated on the basis of a coolant temperature at starting of the engine and a period of time that has elapsed after the starting of the engine.

14 Claims, 4 Drawing Sheets

METHOD AND APPARATUS FOR CONTROLLING CVVT OF AN ENGINE

FIELD OF THE INVENTION

Generally, the present invention relates to a method and an apparatus for controlling continuously variable valve timing (CVVT) of an engine. More particularly the present invention relates to a method and an apparatus for controlling CVVT of an engine that expands an oil temperature range within which the CVVT can properly operate.

BACKGROUND OF THE INVENTION

The performance of an engine substantially depends on the valve timing of its intake and exhaust valves. Typically, a continuously variable valve timing (CVVT) apparatus is capable of changing such valve timing in accordance with driving conditions of the engine. Oil pressure of an engine is usually used to control a CVVT apparatus. Therefore, the performance of the CVVT apparatus is greatly influenced by the temperature and/or viscosity of the oil. The temperature and viscosity of the oil have a close relationship with the temperature of the engine (i.e., coolant temperature). Therefore, it is preferable that the coolant temperature is considered in controlling the CVVT.

An example of considering the coolant temperature in controlling CVVT is found in the Laid-open Publication of Japanese patent application 1999-36905. According to the disclosure therein, the coolant temperature takes a role as a factor in determining whether CVVT is to be operated, and to enable adjustment of an oil pressure duty ratio applied to the CVVT apparatus. Accordingly, a drawback of this system is that the CVVT apparatus is not operated when the engine is cold-started, e.g., when started at a temperature within a range of 0~10° C. Another drawback is that excessive noxious exhaust gas is expelled into the atmosphere because the engine is not properly controlled while in a starting and warm-up mode.

The information disclosed in this Background of the Invention section is only for enhancement of understanding of the background of the invention, and should not be taken as an acknowledgement or any form of suggestion that this information forms the prior art that is already known to a person skilled in the art.

SUMMARY OF THE INVENTION

The present invention discloses a method and an apparatus for controlling CVVT of a vehicle engine based on an estimated oil temperature such that performance of the CVVT can be utilized in the case that the engine is cold-started. An embodiment of a method for controlling CVVT of a vehicle engine according to the present invention includes calculating an estimated oil temperature on the basis of coolant temperature at the starting of the engine and a period of time elapsed after the starting of the engine. Also included is storing the estimated oil temperature in a memory and controlling the CVVT based on the estimated oil temperature.

In a further embodiment, the calculating of the estimated oil temperature includes calculating a primitively estimated oil temperature on the basis of the coolant temperature at starting of the engine and a period of time that has elapsed after the starting of the engine and modifying the primitively estimated oil temperature.

For an A/T vehicle, it is preferable that the modifying of the primitively estimated oil temperature modifies it by multiplying it by a weight factor if: a vehicle speed is greater than a predetermined vehicle speed; an engine speed is greater than a predetermined engine speed; and a throttle opening is greater than a predetermined amount.

For an M/T vehicle, it is preferable that the modifying of the primitively estimated oil temperature modifies it by multiplying it by a weight factor if a vehicle speed is greater than a predetermined vehicle speed and a throttle opening is greater than a predetermined opening.

It is also preferable that the modifying of the primitively estimated oil temperature modifies it by multiplying it by a weight factor if an intake-air temperature is less than a predetermined temperature.

It is also preferable that the modifying of the primitively estimated oil temperature modifies it by multiplying it by a weight factor if a cooling fan of the engine operates.

It is preferable that the method of the present invention further includes determining if the engine has been cold-started, such that the calculating of the estimated oil temperature is executed if the engine has been cold-started.

It is preferable that the method of the present invention further includes detecting a current coolant temperature if the engine has not been cold-started. Also included is the step of determining if a difference between the current coolant temperature and the estimated oil temperature, stored in the memory, is less than a predetermined difference. When the difference is less than a predetermined difference the controlling of the CVVT is based on the estimated oil temperature.

It is preferable that the method of the present invention further includes the steps of detecting a current coolant temperature if the engine has not been cold-started. Also included are the steps of determining if a difference between the current coolant temperature and the estimated oil temperature, stored in the memory, is less than a predetermined difference. If the difference is not less than the predetermined difference the calculating of the estimated oil temperature is executed.

An exemplary apparatus for controlling CVVT of a vehicle engine useful with the present invention includes a coolant temperature detector for detecting coolant temperature of the engine and an electronic control unit that is activated by predetermined software. The electronic control unit is equipped with a timer and a memory. The predetermined software comprises instructions for calculating an estimated oil temperature on the basis of a coolant temperature at starting of the engine and a period of time that has elapsed after the starting of the engine, storing the estimated oil temperature in the memory, and controlling the CVVT based on the estimated oil temperature.

In a further embodiment, the calculating of the estimated oil temperature includes calculating a primitively estimated oil temperature on the basis of the coolant temperature at starting of the engine and the period of time that has elapsed after the starting of the engine and modifying the primitively estimated oil temperature.

For an A/T vehicle, it is preferable that the apparatus of the present invention further includes a vehicle speed detector for detecting a vehicle speed and an engine speed detector for detecting revolution speed of the engine. Also included is a throttle opening detector for detecting a throttle opening of the engine. The oil temperature estimate is also modified by multiplying the estimate by a weight factor if a vehicle speed is greater than a predetermined vehicle speed, an engine speed is greater than a predetermined engine speed, and a throttle opening is greater than a predetermined opening.

For a M/T vehicle, it is preferable that the apparatus of the present invention further includes a vehicle speed detector for detecting a vehicle speed and a throttle opening detector for detecting a throttle opening of the engine. The oil temperature estimate is modified by multiplying it by a weight factor if a vehicle speed is greater than a predetermined vehicle speed and a throttle opening is greater than a predetermined opening.

It is also preferable that the apparatus of the present invention further includes an intake-air temperature detector for detecting intake-air temperature of the engine such that the modifying of the primitively estimated oil temperature modifies it by multiplying it by a weight factor if an intake-air temperature is less than a predetermined temperature.

It is also preferable that the apparatus of the present invention further includes a fan switch for controlling operation of a cooling fan of the engine, such that the modifying of the primitively estimated oil temperature modifies it by multiplying it by a weight factor if a cooling fan of the engine operates.

It is preferable that the predetermined software further includes instructions for determining if the engine has been cold-started. The calculating of the estimated oil temperature is then executed if the engine has been cold-started.

It is preferable that the predetermined software further includes instructions for: detecting a current coolant temperature if the engine has not been cold-started. Also included is the steps of determining if a difference between the current coolant temperature and the estimated oil temperature stored in the memory is less than a predetermined difference. If the estimate is less than a predetermined difference the controlling of the CVVT, based on the estimated oil temperature is executed.

It is preferable that the predetermined software further includes instructions for detecting a current coolant temperature if the engine has not been cold-started. Also included is the step of determining if a difference between the current coolant temperature and the estimated oil temperature stored in the memory is less than a predetermined difference. If the difference is not less than a predetermined difference the calculating of the estimated oil temperature is executed.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE INVENTION

Figure 1:
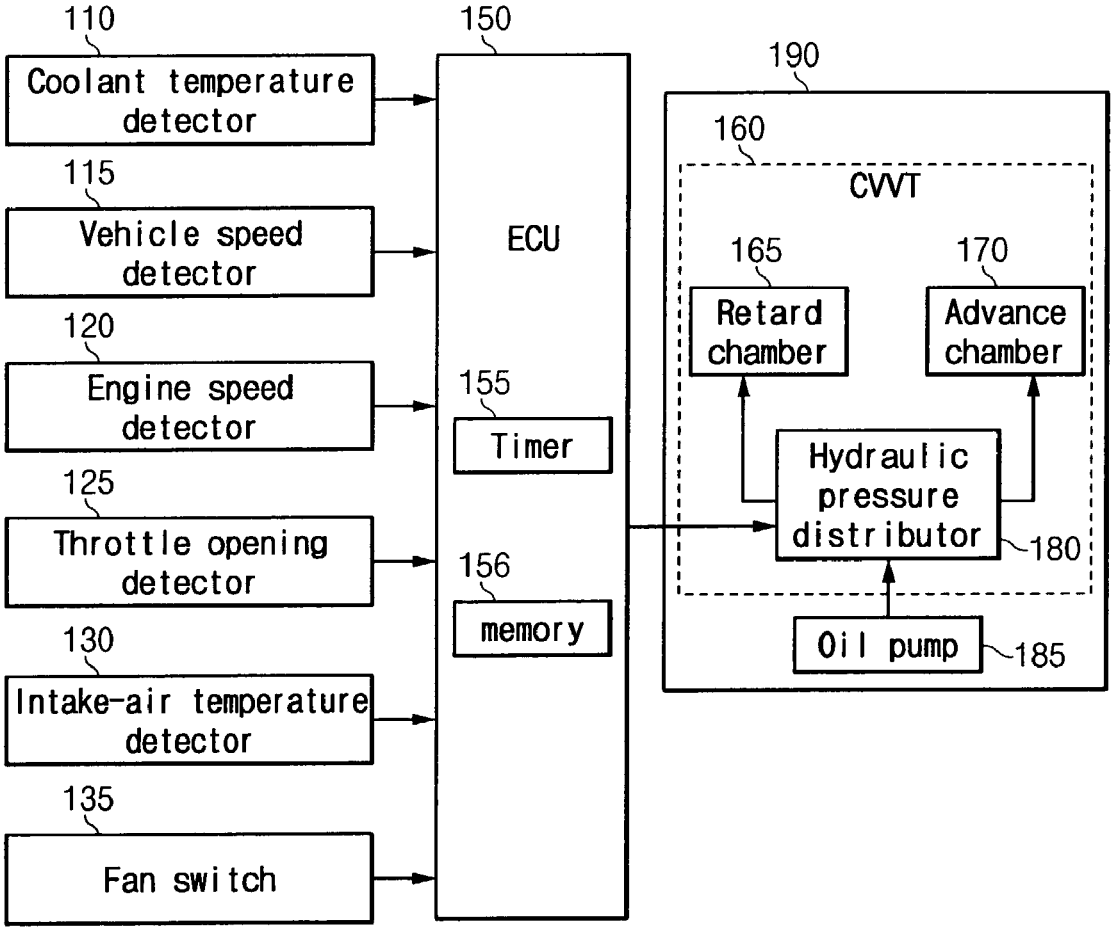
FIG. 1 is a block diagram of an apparatus for controlling a CVVT of an engine according to a preferred embodiment of the present invention.

As shown in FIG. 1, an apparatus for controlling CVVT of an engine according to a preferred embodiment of the present invention controls a CVVT apparatus 160 of a vehicle engine 190. An apparatus for controlling CVVT of an engine according to a preferred embodiment of the present invention includes a detection unit 100 for detecting an operating condition of the engine 190. Further included is an electronic control unit (ECU) 150 for controlling the CVVT apparatus 160 based on signals from the detection unit 100.

The detection unit 100 includes a coolant temperature detector 110 for detecting coolant temperature of the engine 190. A vehicle speed detector 115 is also included for detecting vehicle speed, and an engine speed detector 120 for detecting the revolution speed of the engine 190. A throttle opening detector 125 for detecting a throttle opening of the engine 190, an intake-air temperature detector 130 for detecting intake-air temperature of the engine 190, and a fan switch 135 for controlling operation of a cooling fan of the engine 190.

The ECU 150 can be realized by one or more processors activated by predetermined software. The predetermined software can be programmed to perform each step of a method for controlling CVVT of an engine according to a preferred embodiment of this invention.

As shown in FIG. 1, the ECU 150 is equipped with a timer 155 for measuring an elapsed period of time and with a memory 156 for storing values of predetermined parameters. The CVVT apparatus 160 is equipped with, e.g., a retard chamber 165 and an advance chamber 170, such that valve timing is controlled by controlling selective supplying of hydraulic pressure to the chambers 165 and 170.

Hydraulic pressure is generated by an oil pump 185 connected to a crankshaft (not shown) of the engine 190. The CVVT apparatus 160 is equipped with a hydraulic pressure distributor 180 that selectively supplies the hydraulic pressure to chambers 165 and 170. Accordingly, the ECU 150 controls the valve timing of the engine 190 by controlling the hydraulic pressure distributor 180.

Figure 2A:
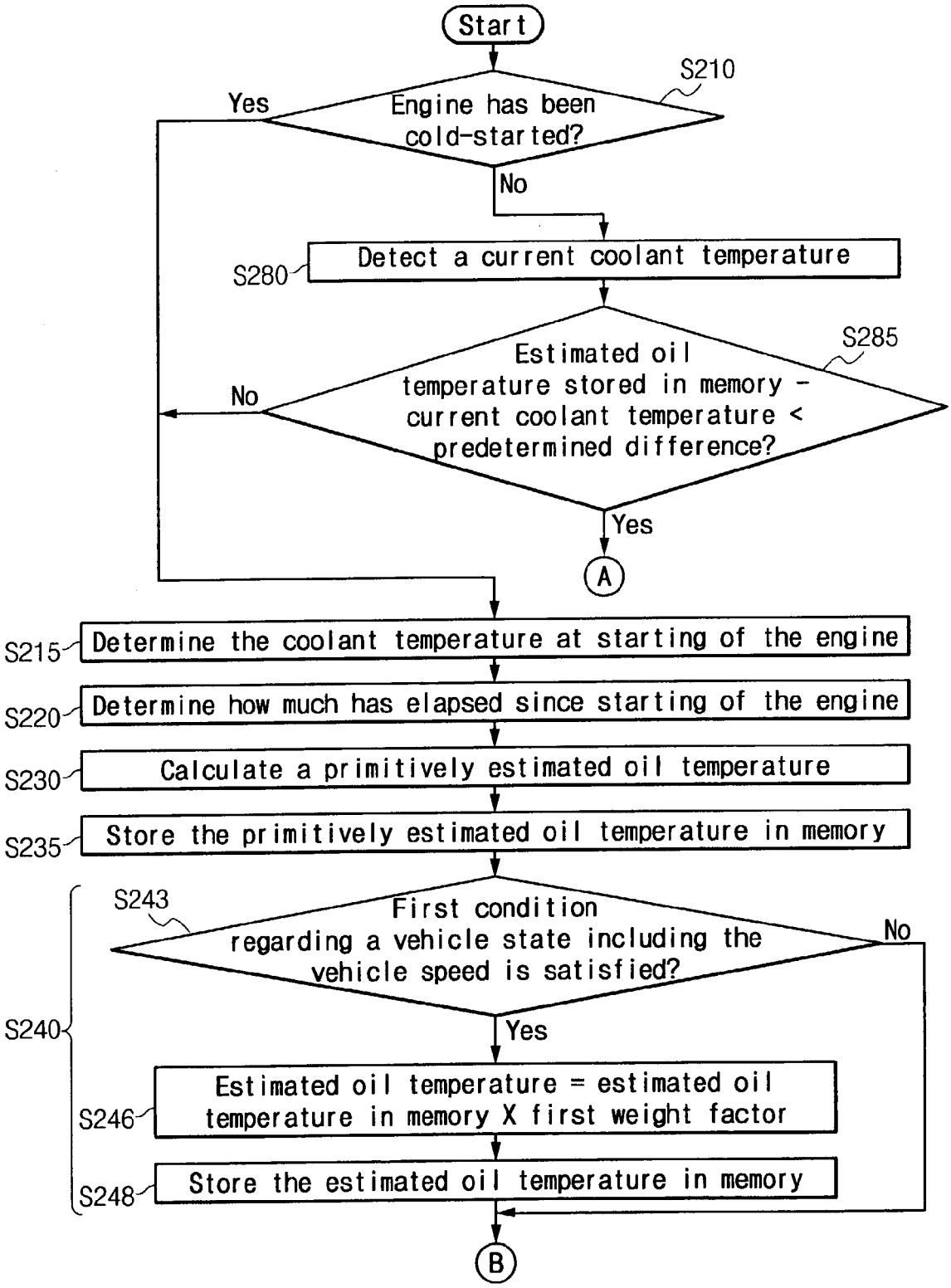
FIGS. 2A and 2B show flowcharts of a method for controlling a CVVT of an engine according to a preferred embodiment of the present invention.
Figure 2B:
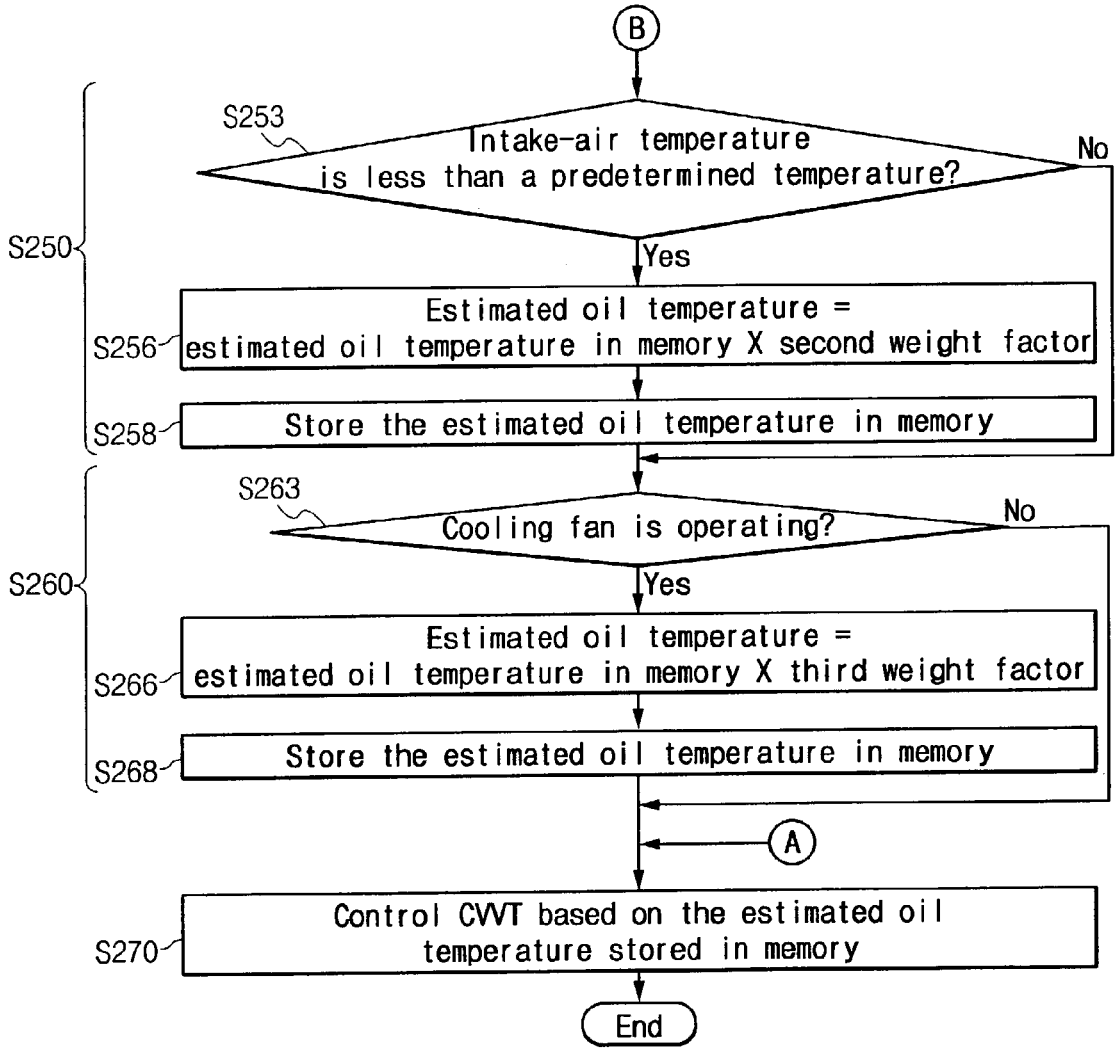

A method for controlling CVVT of a vehicle engine according to a preferred embodiment of the present invention is hereinafter described in detail with reference to FIGS. 2A and 2B. Initially, at step S210, the ECU 150 determines whether the engine 190 has been cold-started. The engine 190 is determined to be cold-started if the coolant temperature at starting of the engine 190 is within a predetermined temperature range (e.g., less than 10° C.). Whether the engine 190 is cold-started is determined at the time of starting the engine 190, and the result of the determination is stored in the memory 156. Therefore, at step S210, the ECU 150 can determine, by retrieving the result from the memory 156, whether the engine 190 has been cold-started.

When the engine 190 has been cold-started, the ECU 150 determines, at step S215, the coolant temperature at starting of the engine 190. This value is then stored in the memory 156. Therefore, the ECU 150 can determine the coolant temperature at starting of the engine, by retrieving the value of the coolant temperature stored in the memory 156. In addition, at step S220, the ECU 150 determines a time period that has elapsed from the starting of the engine, using the timer 155.

At step S230, the ECU 150 calculates an estimated oil temperature on the basis of the coolant temperature at starting of the engine and the period of time that has elapsed after the starting of the engine. Subsequently, at step S235, the ECU 150 stores the estimated oil temperature in the memory 156. Also at step S230, the estimated oil temperature is retrieved from a predetermined lookup table stored in the memory 156.

In the lookup table, for each of a plurality of possible initial coolant temperatures, the estimate of oil temperature is preset depending on the period of time that has elapsed from the starting of the engine. The lookup table can be prepared from simple engine experiments by a person of ordinary skill in the art.

Figure 3:
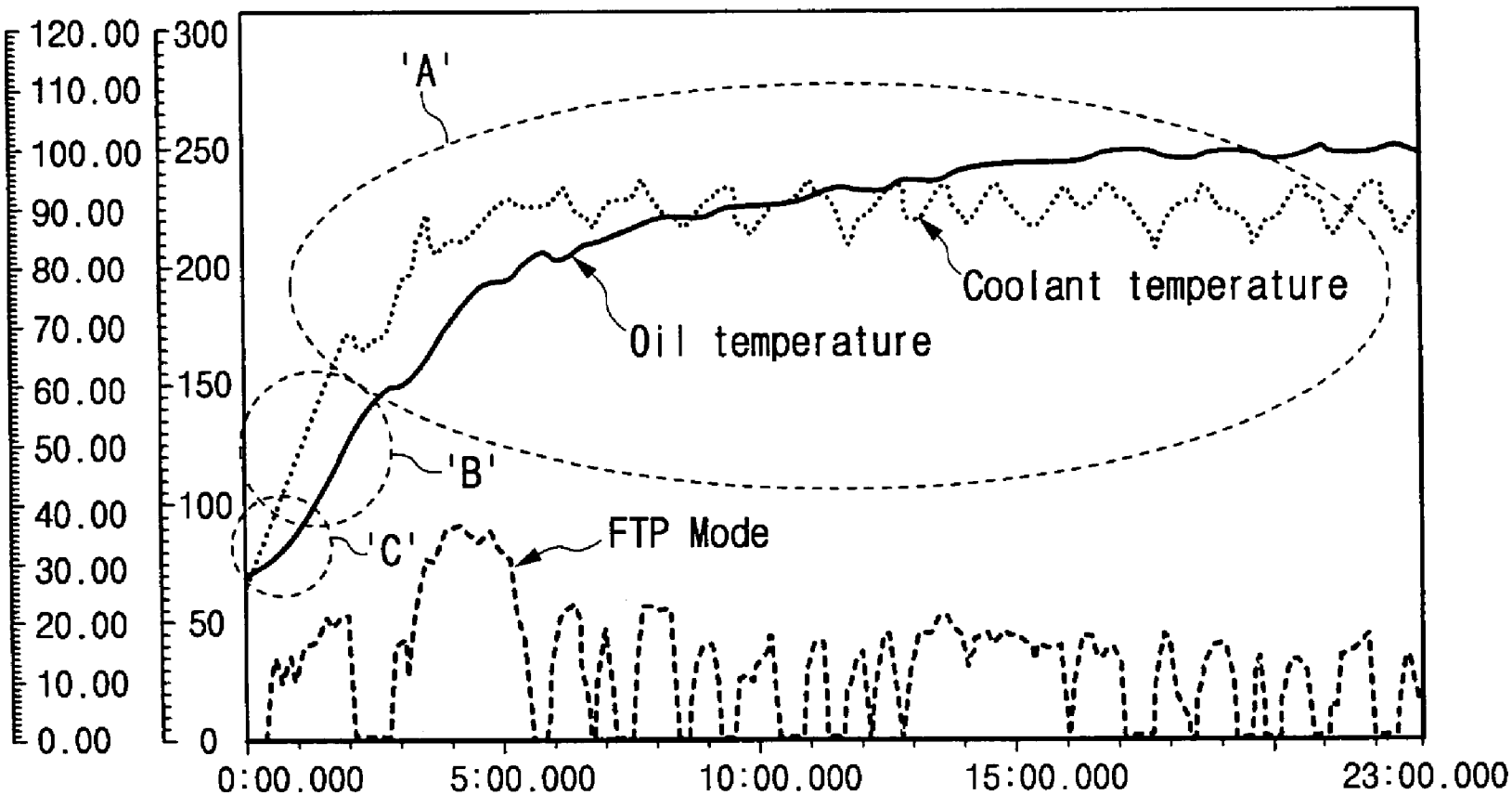
FIG. 3 is an exemplary graph showing how the coolant temperature and oil temperature change according to time after an engine is started when the engine is driven according to a specific mode.

Principles regarding how to prepare such a lookup table are hereinafter explained in detail with reference to FIG. 3. FIG. 3 is an exemplary graph showing how the coolant temperature and oil temperature change according to passage of time that has elapsed since an engine was started, when the engine is driven according to a specific mode, e.g., FTP (Federal Test Procedure) mode. The graph shown in FIG. 3 can be obtained by simple experiments for each of a plurality of initial coolant temperatures at starting of the engine.

The leftmost of the two vertical scales in FIG. 3 denotes coolant temperature, and the rightmost scale denotes vehicle speed. The horizontal axis denotes time elapsed from the starting of the engine with the scale format of "minutes: seconds". In addition, FIG. 3 illustrates the case in which the coolant temperature and oil temperature at starting of the engine are approximately 30° C. The region "C" denotes temperatures immediately after starting the engine, "B" denotes that the coolant temperature is less than a normal range, and "A" denotes that the coolant temperature is approximately in a normal range.

The viscosity of oil lowers as its temperature rises, and the response speed of a CVVT apparatus increases as the viscosity of the oil lowers. Therefore, the response speed of a CVVT apparatus according to the control of the ECU is almost at its maximum in the region "A". In the regions "B" and "C", the response speed of a CVVT apparatus increases almost linearly according to passage of time.

When the engine is sufficiently cooled after an engine stop, the engine oil is also sufficiently cooled, and thus the coolant temperature and the oil temperature can be regarded to have sufficiently similar temperatures. Therefore, when an engine is cold-started, a current oil temperature of the engine can be estimated on the basis of the coolant temperature at starting of the engine and the period of time that has elapsed after the starting of the engine. Accordingly, a tendency of oil temperature change according to period of time that has elapsed from the starting of the engine is experimentally obtained for each of a plurality of initial coolant temperatures, and the tendency of oil temperature is formularized as the lookup table stored in the memory 156.

The coolant temperature and the oil temperature also have sufficiently similar temperatures if a short period of time has passed during the engine stop. In that sense, the lookup table includes data for the case that the coolant temperature is not within a cold-start range and lies in a normal range.

In addition, it is notable in FIG. 3 that, in the region "A", oil temperature does not sensitively respond to operation of a cooling fan, whereas the coolant temperature fluctuates according to whether a cooling fan operates. Therefore, the change in oil temperature according to operation of the cooling fan can be estimated with sufficient precision.

Now referring back to FIGS. 2A and 2B, when the ECU 150 has calculated the estimated oil temperature and then stored it in the memory 156 at the steps S230 and S235, the ECU 150 modifies the stored oil temperature based on several conditions (refer to S240 to S260). The oil temperature estimated under the fixed mode as shown in FIG. 3 may be different from the actual oil temperature. Therefore, a modification of the estimated oil temperature is needed.

At step S240, the ECU 150 modifies the estimated oil temperature referring to vehicle state conditions, including vehicle speed. In more detail, at step S243, the ECU 150 determines whether a first condition regarding a vehicle state including the vehicle speed is satisfied. When the first condition is satisfied, the ECU 150 modifies the estimated oil temperature, step S246, by multiplying the estimated oil temperature by a first weight factor. At step S248, this value is stored in the memory 156.

The first condition may be set differently according to whether the vehicle having the CVVT engine 190 is equipped with an automatic transmission (A/T vehicle), or a manual transmission (M/T vehicle).

In the case that the vehicle is equipped with an A/T, the first condition is preferably set as the vehicle speed being greater than a predetermined vehicle speed, the engine speed being greater than a predetermined engine speed, and a throttle opening being greater than a predetermined throttle opening.

In the case that the vehicle is equipped with a M/T, the first condition is preferably set as the vehicle speed being greater than a predetermined vehicle speed and a throttle opening being greater than a predetermined opening.

Preferable values of the first weight factor, the predetermined vehicle speed, the predetermined engine speed, and the predetermined opening may depend on specifications of the engine and the vehicle. These values can be readily obtained experimentally by a person of an ordinary skill in the art. The first weight factor is preferably set as a value of less than 1, e.g., a value in the range of 0.8 to 0.9. In addition, at step S250, the ECU 150 modifies the estimated oil temperature referring to an intake-air temperature. The intake-air temperature may influence the tendency of the oil temperature change. At step S253, the ECU 150 determines whether an intake-air temperature is less than a predetermined temperature. The intake-air temperature is measured by the intake-air temperature detector 130.

At step S256, the ECU 150 modifies the estimated oil temperature stored in the memory 156. The oil temperature is modified by multiplying the estimated oil temperature by a second weight factor if the intake-air temperature is less than a predetermined temperature. At step S258, the ECU 150 stores the estimated oil temperature modified as such in the memory 156.

Preferable values of the predetermined temperature and the second weight factor may depend on specifications of the engine and the vehicle. However, they can be readily obtained experimentally by a person of ordinary skill in the art. The second weight factor is preferably set as a value of less than 1, e.g., a value in the range of 0.8 to 0.9.

In addition, at step S260, the ECU 150 modifies the estimated oil temperature referring to whether a cooling fan of the engine 190 is operated. The operation of the cooling fan may influence the tendency of the oil temperature change. In more detail, at step S263, the ECU 150 determines whether a cooling fan of the engine is operating based on the signal from the fan switch 135.

At step S266, the ECU 150 modifies the estimated oil temperature stored in the memory 156 by multiplying the estimated oil temperature by a third weight factor if the cooling fan is operating. At step S268, the ECU 150 stores the estimated oil temperature modified as such in the memory 156.

A preferable value of the third weight factor may depend on specifications of the engine and the vehicle. However, it can be readily obtained experimentally by a person of ordinary skill in the art. The third weight factor is preferably set as a value of less than 1, e.g., a value in the range of 0.8 to 0.9.

When the modification of the estimated oil temperature is finished by the steps S240, S250, and S260, at step S270 the ECU 150 retrieves the estimated oil temperature stored in the memory 156 and controls the CVVT apparatus 160 based thereon.

In more detail, the ECU 150 calculates an energizing time of the CVVT apparatus 160 based on the stored oil temperature, and then controls the hydraulic pressure distributor 180 based on the calculated energizing time. Therefore, appropriate valve timing is achieved regardless of the oil temperature. The energizing time denotes, as well known in the art, a time period from applying a control signal to the hydraulic pressure distributor to actual distribution of hydraulic pressure.

Also, in the case that the engine has not been cold-started, it is preferable that the oil temperature is precisely estimated. Therefore, the ECU 150 detects a current coolant temperature at step S280 if it is determined at the step S210 that the engine 190 has not been cold-started. Subsequently, at step S285, the ECU 150 compares a temperature difference between the estimated oil temperature stored in the memory 156 and the current coolant temperature, to a predetermined difference. When the temperature difference is less than the predetermined difference, it can be understood that the engine 190 has not cooled much during an engine stop. Therefore, the ECU 150 proceeds to execute the step S270 of controlling the CVVT apparatus 160 based on the estimated oil temperature stored in the memory 156.

However, when the temperature difference is not less than the predetermined difference, it can be understood that the engine 190 has cooled excessively during an engine stop. Therefore, in this case, the ECU 150 proceeds to execute the step S215 of determining the coolant temperature at starting of the engine 190 such that a new estimate value of oil temperature is be obtained.

While this invention has been described in connection with what is presently considered to be the most practical and preferred embodiment, it is to be understood that the invention is not limited to the disclosed embodiments, but on the contrary, is intended to cover various modifications and equivalent arrangements included within the spirit and scope of the appended claims.

Throughout this specification and the claims which follow, unless explicitly described to the contrary, the word "comprise" or variations such as "comprises" or "comprising" will be understood to imply the inclusion of stated elements but not the exclusion of any other elements.

What is claimed is:

1. A method for controlling continuously controlling valve timing of a vehicle engine, comprising:

determining if an engine has been cold-started;

if it is determined that the engine has been cold-started calculating an estimated oil temperature on the basis of a coolant temperature at starting of the engine and a period of time that has elapsed after the starting of the engine;

storing the estimated oil temperature in a memory;

controlling the continuously controlling valve timing based on the estimated oil temperature;

if it is determined that the engine has not been cold-started, detecting a current coolant temperature; and determining if a difference between the current coolant temperature and the estimated oil temperature stored in the memory is less than a predetermined difference, wherein the controlling of the continuously controlling valve timing based on an energizing time calculated from the estimated oil temperature is executed when the difference between the current coolant temperature and the estimated oil temperature stored in the memory is less than the predetermined difference.

2. The method of claim 1, wherein the calculating of the estimated oil temperature comprises:

calculating a primitively estimated oil temperature on the basis of the coolant temperature at starting of the engine and the period of time that has elapsed after the starting of the engine; and modifying the primitively estimated oil temperature.

3. The method of claim 2, wherein the modifying of the primitively estimated oil temperature modifies it by multiplying it by a weight factor if a vehicle speed is greater than a predetermined vehicle speed, an engine speed is greater than a predetermined engine speed, and a throttle opening is greater than a predetermined opening.

4. The method of claim 2, wherein the modifying of the primitively estimated oil temperature modifies it by multiplying it by a weight factor if a vehicle speed is greater than a predetermined vehicle speed, and a throttle opening is greater than a predetermined opening.

5. The method of claim 2, wherein the modifying of the primitively estimated oil temperature modifies it by multiplying it by a weight factor if an intake-air temperature is less than a predetermined temperature.

6. The method of claim 2, wherein the modifying of the primitively estimated oil temperature modifies it by multiplying it by a weight factor if a cooling fan of the engine operates.

7. The method of claim 1, further comprising:

detecting a current coolant temperature if the engine has not been cold-started; and determining if a difference between the current coolant temperature and the estimated oil temperature stored in the memory is less than a predetermined difference, wherein the calculating of the estimated oil temperature is executed when the difference between the current coolant temperature and the estimated oil temperature stored in the memory is not less than the predetermined difference.

8. An apparatus for controlling continuously controlling valve timing of a vehicle engine, comprising:

a coolant temperature detector for detecting coolant temperature of the engine; and an electronic control unit that is activated by predetermined software, the electronic control unit being equipped with a timer and a memory, wherein the predetermined software comprises instructions for:

calculating an estimated oil temperature on the basis of a coolant temperature at starting of the engine and a period of time that has elapsed after the starting of the engine;

storing the estimated oil temperature in the memory;

controlling the continuously controlling valve timing based on the estimated oil temperature;

determining if the engine has been cold-started, wherein the calculating of the estimated oil temperature is executed if the engine has been cold-started;

detecting a current coolant temperature if the engine has not been cold-started; and determining if a difference between the current coolant temperature and the estimated oil temperature stored in the memory is less than a predetermined difference, and wherein the controlling of the continuously controlling valve timing based on the estimated oil temperature is executed when the difference between the current coolant temperature and the estimated oil temperature stored in the memory is less than the predetermined difference.

9. The apparatus of claim 8, wherein the calculating of the estimated oil temperature comprises:

calculating a primitively estimated oil temperature on the basis of the coolant temperature at starting of the engine and the period of time that has elapsed after the starting of the engine; and modifying the primitively estimated oil temperature.

10. The apparatus of claim 9, further comprising:

a vehicle speed detector for detecting a vehicle speed; an engine speed detector for detecting revolution speed of the engine; and a throttle opening detector for detecting a throttle opening of the engine, wherein the modifying of the primitively estimated oil temperature modifies it by multiplying it by a weight factor if the vehicle speed is greater than a predetermined vehicle speed, the engine speed is greater than a predetermined engine speed, and the throttle opening is greater than a predetermined opening.

11. The apparatus of claim 9, further comprising:

a vehicle speed detector for detecting a vehicle speed; and a throttle opening detector for detecting a throttle opening of the engine, wherein the modifying of the primitively estimated oil temperature modifies it by multiplying it by a weight factor if the vehicle speed is greater than a predetermined vehicle speed, and the throttle opening is greater than a predetermined opening.

12. The apparatus of claim 9, further comprising an intake-air temperature detector for detecting intake-air temperature of the engine, wherein the modifying of the primitively estimated oil temperature modifies it by multiplying it by a weight factor if the intake-air temperature is less than a predetermined temperature.

13. The apparatus of claim 9, further comprising a fan switch for controlling operation of a cooling fan of the engine, wherein the modifying of the primitively estimated oil temperature modifies it by multiplying it the by a weight factor if the cooling fan of the engine operates.

14. The apparatus of claim 8, wherein the predetermined software further comprises instructions for:

detecting a current coolant temperature if the engine has not been cold-started; and determining if a difference between the current coolant temperature and the estimated oil temperature stored in the memory is less than a predetermined difference, and wherein the calculating of the estimated oil temperature is executed when the difference between the current coolant temperature and the estimated oil temperature stored in the memory is not less than the predetermined difference.

* * * * *